US007632364B1

(12) United States Patent
Jouet et al.

(10) Patent No.: US 7,632,364 B1
(45) Date of Patent: Dec. 15, 2009

(54) ENERGETIC COMPOSITE MATERIALS CONTAINING INORGANIC PARTICLE NETWORK, AND ARTICLES OF MANUFACTURE AND METHODS REGARDING THE SAME

(76) Inventors: Richard Jason Jouet, 1825 Burke St. SE., Washington, DC (US) 20003; Andrea D. Warren, 311 7th St., NE., Washington, DC (US) 20002; Thomas P. Russell, 9236 Matthew Dr., Manassas Park, VA (US) 20111

( * ) Notice: Subject to any disclaimer, the term of this patent is extended or adjusted under 35 U.S.C. 154(b) by 0 days.

(21) Appl. No.: 10/695,349

(22) Filed: Nov. 10, 2004

(51) Int. Cl.
*C06B 33/00* (2006.01)
*D03D 23/00* (2006.01)
*D03D 43/00* (2006.01)

(52) U.S. Cl. ..... 149/37; 149/109.4; 149/109.6

(58) Field of Classification Search ..... 149/37, 149/109.4, 109.6
See application file for complete search history.

(56) References Cited

U.S. PATENT DOCUMENTS

| | | | | |
|---|---|---|---|---|
| 4,282,174 | A | 8/1981 | Chase et al. | 264/111 |
| 5,545,432 | A | 8/1996 | DeGuire et al. | 427/226 |
| 5,594,064 | A * | 1/1997 | Bradshaw | 524/507 |
| 5,993,935 | A | 11/1999 | Rasmussen et al. | 428/120 |
| 6,099,897 | A | 8/2000 | Sayo et al. | 427/180 |
| 6,299,983 | B1 * | 10/2001 | Van Alsten | 428/470 |
| 6,326,437 | B1 | 12/2001 | Tsuda et al. | 525/276 |
| 6,417,265 | B1 | 7/2002 | Foulger | 524/495 |
| 6,444,318 | B1 | 9/2002 | Guire et al. | 428/412 |
| 6,476,098 | B1 | 11/2002 | Arakawa et al. | 523/206 |
| 6,548,590 | B1 | 4/2003 | Koloski et al. | 524/492 |
| 6,569,937 | B2 | 5/2003 | Foulger et al. | 524/496 |
| 6,582,754 | B1 | 6/2003 | Pasic et al. | 427/2.24 |
| 6,589,629 | B1 | 7/2003 | Bao et al. | 428/144 |
| 2002/0192476 | A1 | 12/2002 | Kambe et al. | 428/447 |
| 2003/0077452 | A1 * | 4/2003 | Guire et al. | 428/412 |

* cited by examiner

*Primary Examiner*—Jerry Lorengo
*Assistant Examiner*—James E McDonough
(74) *Attorney, Agent, or Firm*—Fredric Zimmerman

(57) ABSTRACT

An energetic composite material is provided that includes inorganic particles and self-assembled monolayers (SAMs) formed on the inorganic particles. The SAMs include multifunctional linking molecules and optionally non-linking molecules. The multifunctional linking molecules have linking functional groups respectively chemically bonding to a corresponding pair of the inorganic particles so that the multifunctional linking molecules interconnect the inorganic particles to one another to form a network of inorganic particles. The optional non-linking molecules include a non-linking functional group chemically bonded to a corresponding one of the inorganic particles. Preferably, the multifunctional linking molecules and/or the optional non-linking molecules are fluorinated. Also preferably, bare aluminum particles are selected as the inorganic particles and are passivated with the SAMs.

62 Claims, 2 Drawing Sheets

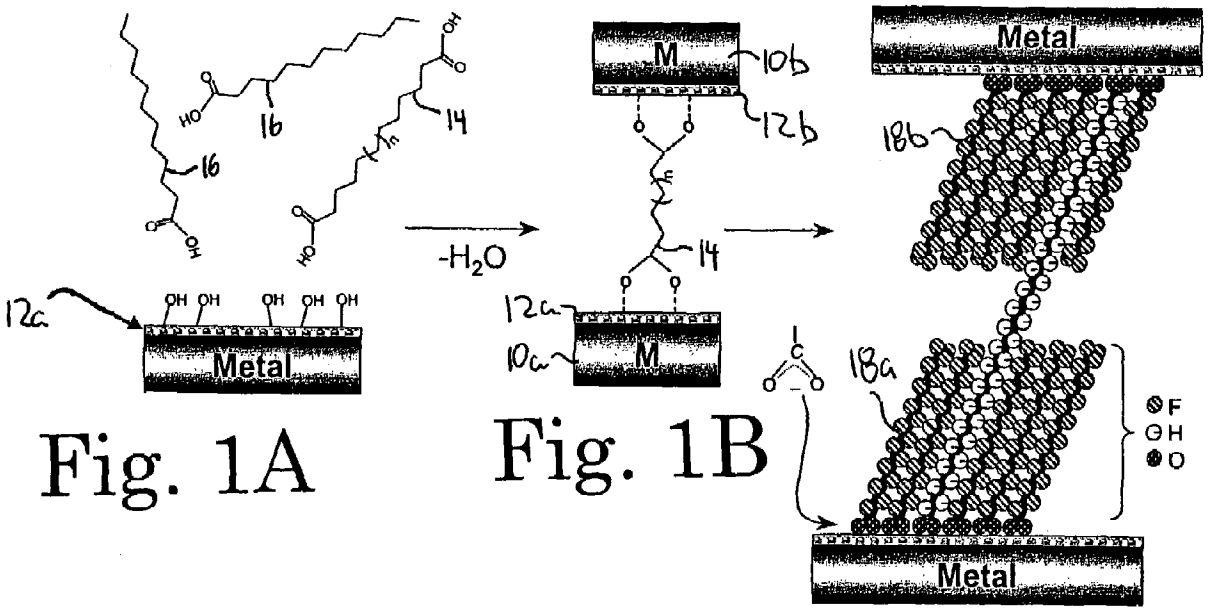
Fig. 1C
Fig. 1B
Fig. 1A
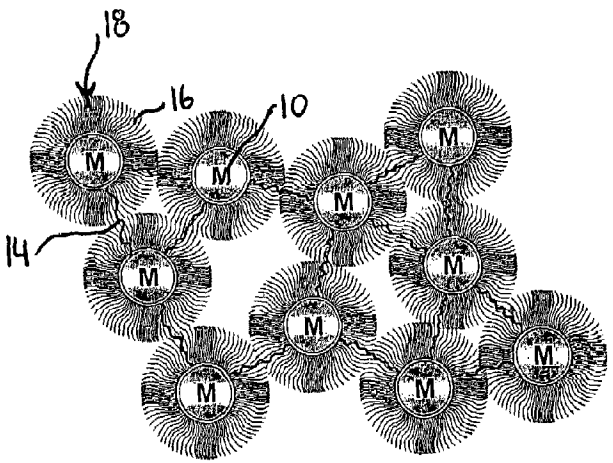
Fig. 2

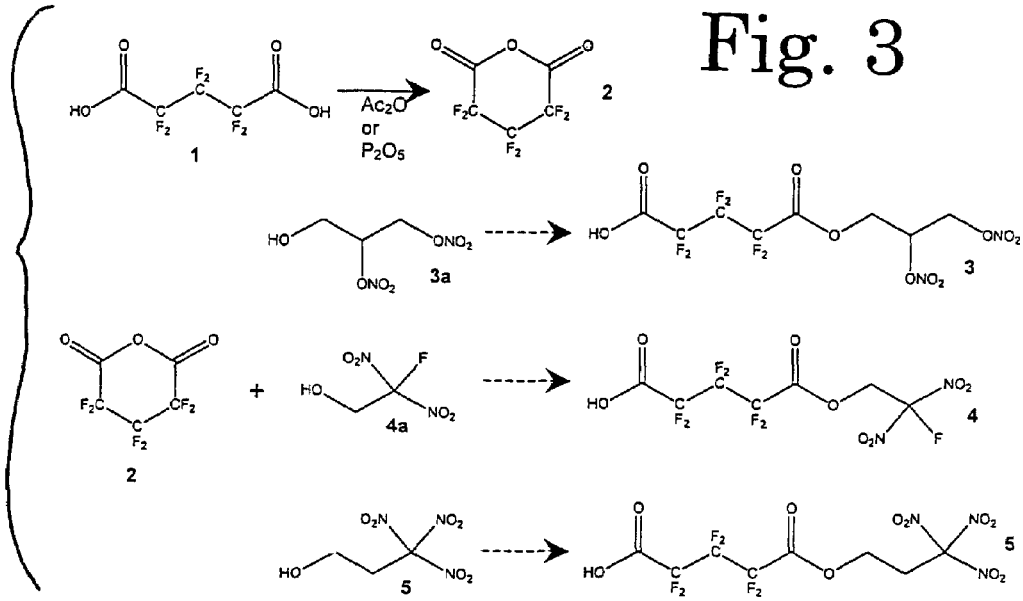
Fig. 3
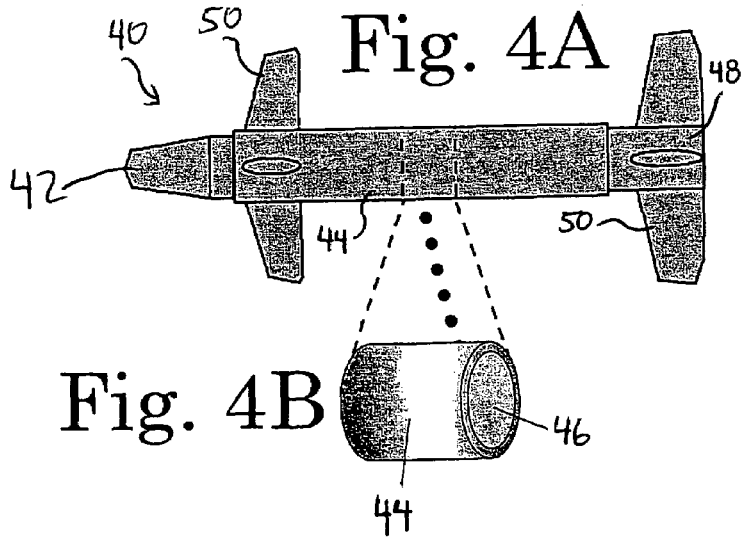
Fig. 4A
Fig. 4B

ENERGETIC COMPOSITE MATERIALS CONTAINING INORGANIC PARTICLE NETWORK, AND ARTICLES OF MANUFACTURE AND METHODS REGARDING THE SAME

STATEMENT REGARDING FEDERALLY SPONSORED RESEARCH OR DEVELOPMENT

The invention described herein may be manufactured and used by or for the Government of the United States of America for governmental purposes without the payment of any royalties thereon or therefore.

BACKGROUND OF THE INVENTION

1. Field of the Invention

This invention relates to the field of composite materials, especially energetic composite materials, composite articles, and methods for making and using the same. The composite materials of embodiments of the present invention are particularly useful as an energetic structural component, such as a reactive fragment, reactive projectile or casing of an explosive, pyrotechnic, gas generator and the like.

2. Description of the Related Art

Metallization of energetic materials is a method use to increase the total energy of an explosive whereby a combustible metal fuel is added to explosive formulations. Conventional metallized explosive formulations and other energetic materials commonly comprise a combination of metallic fuel particles, oxidizer particles, organic binder, and optionally energetic and non-energetic fillers. Aluminum is one of the most commonly used and well known metallic fuels, while ammonium perchlorate and/or ammonium nitrate are often selected as the oxidizer(s) of choice.

However, a drawback of conventional energetic materials is that the reaction between metallic particles such as aluminum and oxidizers such as ammonium perchlorate and ammonium nitrate is diffusion limited, inasmuch as the reactants must travel over a distance in the composition before reaching and reacting with one another As a result, conventional metallized energetic materials are more suitable for applications requiring relatively slow reaction events, such as in the case of underwater explosives. On the other hand, in applications requiring a relatively fast reaction event, such as in the case of metal driving and blast explosives, much of the metallic fuel may be wasted or not optimized in use due to the diffusion limiting reaction between the metallic fuel and oxidizer. Therefore, metallized energetic formulations generally are not used for these tasks.

Another drawback associated with conventional energetic materials is that the metallic particles, especially aluminum, tend to oxidize in stable non-inert atmospheres. In the case of micron-sized particles, oxidation at the aluminum surface may form an oxide layer, which increases the diffusion time required for reaction between the metallic particles and the oxidizer. In the case of nanometer scale particles (or nanoparticles), the oxide layer formed on the metallic particles may become sufficiently appreciable to constitute a weight penalty.

Additional drawbacks associated with conventional energetic materials involve agglomeration and migration of constituents, such as metallic particles or oxidizer particles, within an energetic article. Migration in particular can become a problem for cast energetic materials subjected to prolonged storage. Agglomeration and migration lead to inhomogeneity and increase the reactant diffusion distance, resulting in a slower burn rate and detrimentally affecting performance. As a result, some conventional energetics have limited shelf lives before they must be recycled or destroyed.

Still another drawback associated with energetic materials made from conventional compositions relates to their physical properties. Conventional energetic materials lack sufficient strength and rigidity to allow them to be used as structural components, such as weaponry cartridge cases. As a result, cartridge cases are traditionally made of metals. However, metallic cartridge cases are inert, relatively expensive, and carry a large weight penalty.

3. Objects of the Invention

It is one object of this invention to provide an energetic material that overcomes one or more, and preferably all of the above-discussed drawbacks associated with conventional energetic materials.

It is yet another object of this invention to provide methods for making the energetic materials and energetic articles of manufacture of the present invention.

It is another object of this invention to provide articles of manufacture, such as but not necessarily limited to ammunition casings and reactive projectiles, made from the energetic material of this invention.

SUMMARY OF THE INVENTION

To achieve the foregoing objects, and in accordance with the purposes of the invention as embodied and broadly described in this document, according to a first aspect of this invention there is provided an energetic composite material comprising a plurality of inorganic particles and self-assembling monolayers formed on the inorganic particles. The inorganic particles are selected from the group consisting of metals, metalloids, metal oxides, metalloid oxides, and combinations thereof. The self-assembled monolayers comprise multifunctional linking molecules and optionally non-linking molecules. The multifunctional linking molecules each comprise a respective linking backbone and respective first and second linking functional groups. The linking backbone preferably but optionally comprises a respective first carbon atom. The first and second linking functional groups chemically bond to a corresponding pair of the inorganic particles so that the plurality of multifunctional linking molecules interconnect the inorganic particles to one another to form a network of inorganic particles interconnected by the multifunctional linking molecules. The optional non-linking molecules each comprise a respective non-linking backbone, preferably but optionally comprising a respective second carbon atom, and a respective non-linking functional group chemically bonding to a corresponding one of the inorganic particles. The multifunctional linking molecules and/or the optional non-linking molecules comprises fluorine atoms appended to the carbon atoms of their respective backbones to fluorinate the self-assembled monolayer.

According to a second aspect of the invention, an energetic composite material is provided comprising a plurality of aluminum particles substantially free of oxygen, and self-assembled monolayers formed on the aluminum particles to substantially passivate the aluminum particles. The self-assembled monolayers comprise multifunctional linking molecules, the multifunctional linking molecules each comprising a respective backbone, which preferably yet optionally comprises a carbon atom. The multi-functional linking molecules each further comprises respective first and second functional groups chemically bonding to a corresponding pair of the aluminum particles so as to form a network of the aluminum particles interconnected by the plurality of multifunctional linking molecules.

According to a third aspect of the invention, there is provided an energetic composite material comprising a plurality of aluminum particles substantially free of oxygen, and self-assembling monolayers formed on the aluminum particles to substantially passivate the aluminum particles against oxidation. The self-assembled monolayers comprise multifunctional linking molecules and optionally non-linking molecules. The multifunctional linking molecules each comprise a respective linking backbone and first and second linking functional groups. The linking backbone preferably yet optionally comprises a respective first carbon atom. The first and second linking functional groups chemically bond to a corresponding pair of the aluminum particles so that the plurality of multifunctional linking molecules interconnect the aluminum particles to one another to form a network of aluminum particles interconnected by the multifunctional linking molecules. The optional non-linking molecules each comprise a respective non-linking backbone, which preferably yet optionally comprises a respective second carbon atom, and a respective non-linking functional group chemically bonding to a corresponding one of the aluminum particles.

According to a fourth aspect of the invention, a method for making the energetic composites according to the first, second, and/or third aspects of the invention is provided.

According to a fifth aspect of the invention, an article of manufacture comprising an energetic composite material according to any of the above-described aspects of the invention is provided.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings:

FIGS. 1A, 1B, and 1C illustrate a sequence for the formation of self-assembled monolayers and chemically linking two inorganic particles;

FIG. 2 illustrates a network of self-assembled monolayers linking a plurality of inorganic particles;

FIG. 3 illustrates sequences for functionalizing a self-assembled monolayer molecule with an energetic moiety; and FIGS. 4A and 4B illustrate an example of an article comprising composite material according to an embodiment of the present invention.

DETAILED DESCRIPTION OF PREFERRED EMBODIMENTS AND METHODS OF THE INVENTION

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

The composite material of the present invention comprises a plurality of inorganic particles selected from the group consisting of metals, metalloids, metal oxides, metalloid oxides, and any combination thereof. Referring to FIGS. 1A, 1B, and 1C, first and second inorganic particles of the illustrated embodiment are depicted as rectangular metallic substrates 10*a* and 10*b*, respectively, for convenience sake. Preferred shapes and dimensions of the inorganic particles are described below in greater detail. Also shown in FIGS. 1A and 1B, the metallic substrates 10*a* and 10*b* have metal oxide surfaces 12*a* and 12*b*, respectively, containing exposed and reactive —OH groups.

Self-assembled monolayers 18*a* and 18*b* (FIG. 1C) are formed on the inorganic particles 10*a* and 10*b* by introducing multifunctional linking molecules and optionally non-linking molecules to the inorganic particles. In FIG. 1A, a single multi-functional linking molecule 14 and two mono-functional non-linking molecules 16 are illustrated for convenience sake. The multi-functional linking molecule 14 selected for illustration in FIGS. 1A, 1B, and 1C is a dicarboxylic acid comprising a hydrocarbon backbone 14*a*, a first terminal carboxyl functional group 14*b*, and a second terminal carboxyl functional group 14*c*. The mono-functional non-linking molecules 16 are mono-carboxylic acids each comprising a fluorocarbon backbone 16*a* and a non-linking functional group 16*b*. Although not shown, it is to be understood that the multi-functional linking molecules 14 may be fluorinated instead of or in addition to the non-linking molecules 16. In certain embodiments of the invention, neither the linking molecules 14 nor the non-linking molecules 16 are fluorinated. Other suitable backbones and functional groups for the multi-functional linking and non-linking molecules 14 and 16 are discussed in further detail below.

FIG. 1B illustrates the first and second linking functional groups 14*a* and 14*b* of the linking molecule 14 respectively chemically bonded to a corresponding pair of the first and second inorganic particles 10*a* and 10*b*. In the illustrated embodiment, the reaction may proceed, for example, as a condensation reaction. Turning to the finished structure illustrated in FIG. 2, the multi-functional linking molecules 14 interconnect the inorganic particles 10 to one another to form a network of at least three inorganic particles 10 interconnected by the multi-functional linking molecules 14. Although FIGS. 1B, 1C, and 2 illustrate a single linking molecule 14 linking each corresponding pair of linked inorganic particles (for example, 10*a* and 10*b*) to one another, it is to be understood that a plurality of linking molecules may link any pair of inorganic particles. Generally, a large number of multi-functional linking molecules 14 will be bonded to a given inorganic particle 10, while the other functional groups of the molecules 14 will be linked to at least one, and preferably a plurality of other inorganic particles. It is also to be understood that a given inorganic particle may be linked to only one other inorganic particle, yet still form part of the network. It is also within the scope of this invention and the illustrated embodiment for the composite material to further comprise multi-functional molecules having only one of its functionalities chemically bonded to an inorganic particle, as discussed below.

The non-linking molecules 16 have their respective non-linking functional groups 16*b* chemically bonded to a corresponding one of the inorganic particles 10. Because the opposite ends of the non-linking molecules do not have functional groups bonded to another inorganic particle, the non-linking molecules may be characterized as having tails.

As shown in FIGS. 1C and 2, the multi-functional linking molecules 14 and the non-linking molecules 16 preferably align to establish a self-assembled monolayer ("SAM") 18 or attached layer on the particles 10. Alignment of the molecules of the SAM 18 preferably forms a protective monolayer against the surface, preferably the entire surface, of the inorganic particle 10. With the alignment of the attached layer 18 as a substantially monolayer structure on the particles 10, the layer 18 passivates oxygen-free metal particles, such as bare aluminum discussed below, against oxidation. The attached layer 18 also improves the wettability of the particles 10, improving their compatibility with organic binder. Additionally, the multi-functional linking molecules 14 form a network of the inorganic particles 10 to essentially immobilize the particles 10 against substantial migration.

Further information and details concerning the inorganic particles and SAMs, as well as other aspects of the invention, are provided below.

Inorganic Particles

The composite material of embodiments of the present invention comprise a plurality of inorganic particles. The inorganic particles of the present invention may comprise non-oxidized metals, metal oxides, non-oxidized metalloids, metalloid oxides, and combinations thereof. Preferred metals include, not necessarily by limitation, magnesium, aluminum, titanium, tungsten, hafnium, and combinations thereof. A preferred metalloid is boron. Examples of preferred metal oxides include aluminum oxide, titanium oxide, molybdenum oxide, vanadium oxide, iron oxide, and combinations thereof. Oxygen-passivated aluminum is preferred for some embodiments of the invention.

The inorganic particles may constitute any appropriate size or shape for incorporation into an energetic composite material. For inorganic particles used in energetic composite materials, the preferred shape includes particles having oval or spherical configurations, although other random and nonrandom shapes may be used for the inorganic particles. Preferred sizes of these inorganic particles are nanometer or micron-sized. Preferably, the inorganic particles are spherical particles having particle sizes (diameters) in a range of from about 5 nm to about 3,000 nm (or about 3 microns), and more preferably from about 50 nm to about 2,000 nm (or about 2 microns). Nanoparticles are commercially available through companies such as Valimet Inc., Nanotechnologies Inc., Technanogy, and Strem Chemicals, Inc.

The inorganic particles may be present in a multi-modal distribution, if desired. According to one such embodiment, a bi-modal distribution comprises two particle size distributions having at least one magnitude difference in diameter dimension (on metric scale). Preferred ranges of bimodal particle size distributions are 5 nm-50 nm, 20 nm-2 μm, and 50 nm-5 μm Variation in the particle material, shape, and size will generally vary the physical and chemical properties of the networked composite material. For example, smaller size particles have greater surface areas per unit weight than large particles, and therefore will exhibit better binder-particle interaction. This interaction affects physical properties of the resulting composite, for example, generally improving homogeneity and lowering brittleness.

According to a preferred embodiment of the invention, the inorganic particles are derived from a bare or unprotected (i.e., unpassivated) aluminum mass, also known in the art as purified aluminum. A coating comprising a passivation layer is preferably formed in-situ on the surface of bare aluminum particles for substantially preventing the aluminum mass from combining with non-aluminum components, particularly oxygen. As such, the passivation layer increases the usefulness of the aluminum mass by making the aluminum mass non-reactive or substantially non-reactive in non-inert environments, e.g., when exposed to an oxygen-containing atmosphere. The passivation layer preferably comprises a mono-layer structure attached to the aluminum particles, and is formed from multifunctional linking molecules and non-linking molecules, as described in further detail below. The terms aluminum particles and bare aluminum particles are used interchangeably to describe the same particles, although generally the term bare aluminum particle is used to describe particles prior to chemically bonding attaching molecules and the term aluminum particle is used to describe particles after chemically bonding to attached molecules. Likewise, the terms particles and masses are used interchangeably herein.

The bare aluminum may be formed from any appropriate process for producing purified aluminum. Bare aluminum, particularly in the form of pure fine powders, is pyrophoric. Methods of production include, for example without limitation, the process disclosed in U.S. Pat. No. 6,179,899 to Higa et al. (referred to herein as the "Higa patent"), the disclosure of which is hereby incorporated by reference for teaching bare aluminum production. The Higa patent references several methods for producing bare aluminum powders. These methods include exploding aluminum wire in a vacuum by a high electric current; condensation of vaporized aluminum in a current of cold inert gas, and plating aluminum on a substrate by the decomposition of a tertiary amine complex of aluminum hydride in vapor form at pressures of up to 30 mm of mercury without a catalyst and at temperatures of 125° C. to 550° C. The Higa patent cites U.S. Pat. No. 3,462,288 for plating aluminum on a substrate from an alkyl or aryl substituted aluminum hydride complexed with an ether or a nitrogen containing compound and catalyzed. The Higa patent further cites U.S. Pat. Nos. 3,535,108 and 3,578,436 for methods for producing purified aluminum in particulate form by the conversion of "crude" aluminum to a dialkylaluminum hydride followed by decomposition of the dialkylaluminum hydride at room to 260° C., and a related method of decomposition of diethylhydridoaluminum or diisobutylhydridoaluminum in diisopropyl ether or triethylamine at 90° C. to 185° C. to produce 99.97 percent pure particulate aluminum along with twice the molar quantity of the corresponding trialkylaluminum (using titanium isopropoxide catalyst in an amount by weight of 1 part per 3000 parts aluminum produced). The Higa patent discloses fine aluminum powders prepared by decomposing alane-adducts in organic solvents under an inert atmosphere to provide uniform sized particles from about 65 nm to about 500 nm with titanium catalyst provided as a halide, amide, alkoxide, and other titanium compounds and the corresponding catalyst compounds of zirconium, hafnium, vanadium, niobium, and tantalum.

Preferably, formation of the unprotected aluminum mass occurs in an inert environment, generally through decomposition of an aluminum composition. Representative examples of forming bare aluminum masses include fine aluminum powders formed under an inert atmosphere, such as argon, helium, neon or other like gases. Under this atmosphere, decomposition reactions of alane adducts, including for example and without limitation trialkyl (NRR'R"), heterocyclic, and aromatic amines such as trimethylamine, dimethylethylamine, triethylamine, methyldiethylamine, tripropylamine, triisopropylamine, tributylamine, tetramethylethylenediamine (TMEDA), N-methylpyrrolidine, and pyridine; and ethers (ROR') such as dimethyl ether, diethyl ether, propyl ether, isopropyl ether, dioxane, tetrahydrofuran, dimethoxymethane, diglyme, triglyme, and tetraglyme) occur in organic solvent solutions containing a catalyst. N-methylpyrrolidine, $CH_3N(\eta_2BC_4H_8)$, is the preferred alane adduct. The solvent includes any appropriate aromatic solvent such as toluene, benzene, and mesitylene; a polar solvent such as diethyl ether, propyl ether, isopropylether, dimethoxymethane, tetrahydrofuran, diglyme, triglyme, and tetraglyme; an aliphatic solvent such as hexane, heptane, octane, and nonane; or an amine such as triethylamine, tripropylamine, triisopropylamine, and pyridine, with toluene, TMEDA, xylene and dioxane preferred. Appropriate catalyst include, for example without limitation, compounds of titanium, zirconium, hafnium, vanadium, or niobium including a halide such as $TiX_4$, $ZrX_4$, $HfX_4$, $VX_3$, $VX_4$, $VOCl_3$, $NbX_3$, $NbX_4$, $NbX_5$, $TaX_5$ where X=F, Cl, Br, I; an alkoxide such as $Ti(OR)_4$, $Zr(OR)_4$, $Hf(OR)_4$, $V(OR)_3$, $Nb(OR)_3$, $Nb(OR)_5$, $Ta(OR)_5$; or an amide such as $Ti(NR_2)_4$, $Zr(NR_2)_4$, $Hf(NR_2)_4$, $V(NR_2)_x$, $Nb(NR_2)_3$, $Nb(OR)_5$), $Ta(NR_2)_5$, where R is an alkyl group such as methyl, ethyl, propyl, isopropyl, butyl, or tert-butyl. Preferred catalysts include titanium (IV) chloride, $TiCl_4$; titanium (IV) isopropoxide, $(i\text{-}PrO)_4$ Ti; and titanium (IV) dimethylamide, $Ti(N(CH_3)_2)_4$.

In forming the bare aluminum mass, the reactions occur at desired reaction temperatures that may be attained by heating an alane adduct solution before or after adding the catalyst or by adding the alane adduct to a catalyst solution already at the reaction temperature. Variable uniform sizes of the formed bare aluminum particles may be created by varying the concentration of the catalyst and by varying the concentration of an adducting species, such as by adding this species in uncompounded form to a solution of an alane adduct or by using an adducting species itself as the solvent. Reaction temperatures include from about −78° C. or higher, such as room temperature to about 162° C., up to the boiling point of the selected solvent, and preferably at convenient working temperatures of from about 10° C. to about 100° C., and most preferably from about 23° C. to about 30° C. Preferably the bare aluminum powders are not isolated from the reaction solvent mixture and are coated with the protective attached layer in situ, as described herein. This minimizes any contamination of the bare aluminum mass by oxygen or nitrogen prior to the placement of the self-assembled monolayer onto the bare aluminum mass.

Self-Assembled Mono-Layers (SAMs)

The self-assembled monolayers comprise multifunctional linking molecules and optionally non-linking molecules (discussed below). The multifunctional linking molecules comprise a backbone (also referred to herein as a "linking backbone") and first and second functional groups (also referred to herein as "linking functional groups") respectively chemically bonded to corresponding first and second ones of the inorganic particles. The linking of multifunctional linking molecules to different inorganic particles forms a network of particles interconnected by the multi-functional linking molecules.

Chemical bonding, as used herein, is intended to broadly cover bonding with some covalent character, with or without polar bonding and can have properties of organometallic bonding along with various degrees of ionic bonding. Preferably, chemical bonding is mostly of a covalent character.

The functional groups of the multifunctional linking molecules are capable of chemical bonding to corresponding inorganic particles, preferably to the surfaces of the inorganic particles. The functional groups of a given multifunctional linking molecule may be the same as or different from one another. Preferably, the multifunctional linking molecules are difunctional, having two functionalities capable of chemically bonding to the inorganic particles. More preferably but optionally, the functional groups of the difunctional linking molecule are terminal groups. However, higher functionality linking molecules, such as trifunctional and tetrafunctional linking molecules, may also be selected. Examples of functional groups useful with embodiments of this invention for chemically bonding to the inorganic particles include carboxylic acid, alcohol, thiol, aldehyde, amide, derivatives of these moieties, and combinations thereof. The functional groups of a given molecule may be the same as or different from one another. Most preferably the multifunctional linking molecules of the self-assembled monolayers include carboxylic acid moieties.

The linking backbones of the multifunctional linking molecules preferably have at least one carbon atom. In one preferred embodiment, the backbone consists of carbon, hydrogen, and optionally fluorine atoms. In another preferred embodiment, the backbone consists of carbon, oxygen, hydrogen, and optionally fluorine atoms. Preferred backbones may be selected from the group consisting of ethers, polyethers, hydrocarbons, fluorinated and perfluorinated derivatives thereof, and combinations thereof. The backbone is optionally, yet preferably, free of aromatic moieties to reduce weight penalty. The backbone preferably has 3 to 40 atoms, and more preferably from about 9 to about 39 atoms, and still more preferably from about 10 to about 25 atoms along a direct path linking the first and second functional groups to one another. Generally, in the case of a hydrocarbon or fluorocarbon, the atoms directly bridge the first and second functional groups to one another are carbon atoms. An example of a difunctional linking molecule having a hydrocarbon backbones is decane-1,10-dicarboxylic acid ($C_{12}H_{22}O_4$ Decane). Polyethers generally have carbon and oxygen atoms along a direct path bridging the functional groups to one another. Examples of polyethers include polyethylene glycol diacid 600 ($C_{26}H_{50}O_6$) provided by Fluka Corporation, a subsidiary of Sigma-Aldrich, and other molecular weight polyethylene glycol diacids. It is also possible to include heteroatoms in the backbone or to select different backbones that are free of carbon or do not contain carbon as the main component. For example, silicon-based polymers and phosphine-borane polymers may be selected for backbones.

The linking backbones of the multifunctional linking molecules are preferably fluorinated, and more preferably are perfluorinated. As referred to herein, fluorinated means a fluorochemical organic compound, not necessarily a hydrocarbon, in which one or more, and preferably at least half, of the hydrogen directly attached to carbon has been replaced by fluorine. Perfluorination means a fluorochemical organic compound, not necessarily a hydrocarbon, in which all of the hydrogen atoms directly attached to carbon have been replaced by corresponding fluorine atoms. Upon detonation or activation of the energetic composite material, the fluorine in the fluorochemical organic compound oxidizes the metallic particles, thereby producing volatile fluoroxy-metal species and releasing heat. Perfluorinated difunctional linking molecules may have the formula $X(CF_2)_nY$, wherein X and Y are the same or different from one another and are preferably selected from the group consisting of carboxylic acid, alcohol, thiol, aldehyde, and amide moieties. A representative range for "n" is from about 3 to about 40. For example, for dicarboxylic acid perfluorinated linking molecules, i.e., $HOOC(CF_2)_nCOOH$, representative molecules include $HO_2C(CF_2)_4CO_2H$, $HO_2C(CF_2)_8CO_2H$ $HO_2C(CF_2)_9CO_2H$, and $HO_2C(CF_2)_{13}CO_2H$. A preferred perfluoro dicarboxylic acid is perfluorosebacic acid ($C_{10}H_2F_{16}O_4$).

Preferably, the multifunctional linking molecules constitute from about 5 weight percent to about 100 weight percent of the total weight of the self-assembled monolayers.

Non-linking self-assembled monolayer molecules preferably contain only one functional group reactive with the inorganic particles, and therefore neither chemically interconnect inorganic particles together nor contribute to the chemical network of inorganic particles. Accordingly, such molecules are referred to herein as "non-linking" or "tail" molecules, although it should be noted that such molecules may contribute to physical linking of particles. Non-linking molecules are preferably present in combination with the multifunctional linking molecules while preparing the self-assembled monolayers. Generally, the non-linking molecules are monofunctional, although it is possible for the molecule to have a functionality that is not reactive with the surface of the inorganic particles. The monofunctional molecules may constitute from 0 weight percent to about 95 weight percent, more preferably about 1 weight percent to about 95 weight percent of the total weight of the self-assembled monolayers.

Representative functional groups for the non-linking molecules are the same as described above for the multifunctional linking molecules, and may include carboxylic acid, alcohol, thiol, aldehyde, amide, derivatives of these moieties, and combinations thereof. The functional group of a non-linking molecule may be the same as or different from the functional groups of the multifunctional linking molecules. Preferably but optionally, the functional group of a non-linking molecule is a terminal group. The non-linking molecules have backbones (also referred to herein as "non-linking backbones") that preferably comprise at least one carbon atom, and may be selected from the group consisting of ethers, polyethers, hydrocarbons, fluorinated and perfluorinated derivatives thereof, and combinations thereof. The backbone is optionally, yet preferably, free of aromatic moieties for reducing weight penalty imparted by the self-assembled monolayer. In the case of hydrocarbons and fluorocarbons, the backbone preferably has from about 4 to about 20 carbon atoms, and more preferably from about 5 to about 14 atoms. In the case of ethers and polyethers, the backbone preferably has about 5 to about 40 carbon and oxygen atoms, and more preferably from about 10 to about 20 carbon and oxygen atoms. Examples of monocarboxylic acid molecules include those having the structures $F_3C(CF_2)_nCOOH$ and $F_2HC(CF_2)_nCOOH$, wherein n is optionally yet preferably in a range from about 3 to about 12. The backbone may be free or substantially free of carbon, if desirable. Example of such backbones include silicon-based polymers and phosphine-borane polymers.

In one currently preferred embodiment, the self-assembled monolayer (SAM) coating is formed on the surface of the bare or unprotected (i.e., unpassivated) aluminum mass. The self-assembled monolayers attach to the bare or unprotected aluminum mass, and protect the aluminum mass from combining with non-aluminum components, particularly oxygen. As such, the protective coating increases the usefulness of the aluminum mass by making the aluminum mass non-reactive in stable, non-inert environments, e.g., when exposed to an oxygen-containing atmosphere. This layer preferably comprises a mono-layer structure attached to the aluminum. Multifunctional linking molecules of a SAM have their first functional groups chemically bonded to the SAM-covered particle, and respective second functional groups available for chemically bonding to other corresponding inorganic particles. In this manner, a multifunctional molecule may contribute to the formation of self-assembled monolayer coatings of two inorganic particles to which it is chemically bonded.

Although the self-assembled monolayer may include any appropriate mass amount for a given purpose, the inorganic particles may be incorporated at a wide range of loadings into the composite, including high particle loading. Preferably the monolayer is present in an appropriate mass amount, such as approximately 5:1 molar ratio of inorganic particles to SAM. Generally, smaller inorganic particle sizes have larger surface areas per unit weight than larger inorganic particle sizes. As a consequence, on a unit weight basis, smaller inorganic particles generally require more self-assembled monolayer molecules than larger inorganic particles. The ratio of inorganic particles to SAM materials may also change with changes in reaction conditions, such as reaction temperature, solvent, etc. Appropriate molar ratios may include, for example without limitation, ratios of from about 6:1; 10:1; 20:1, etc. The weight percentage of the attached layer on the inorganic particles also may be tailored to a given purpose, such that the weight percentage of the attached layer relative to the total energetic composite weight may range from about 85 weight percent or less, 65 weight percent or less, 50 weight percent or less, 25 weight percent or less, and other such weight percentages including intermediate weight percentages, with variations of the weight percentage providing optimum protective coverage of the inorganic particles for changes of particle size, changes in the molecular weight of the SAM, etc.

It should be noted that multifunctional molecules may have a free functional group that does not chemically bond with an inorganic particle. The relative amounts of multifunctional linking molecules, non-linking molecules, and inorganic particles influences whether a multi-functional molecule is bonded on both ends to respective inorganic particles or only at one end with an inorganic particle.

In an optional modification to the embodiments of the present invention, some or all of the molecules constituting the self-assembled monolayer includes an energetic moiety. Examples of energetic moieties include nitro, nitramine, nitrate ester, azide, and difluoro-amino groups. With and without the inclusion of an energetic moiety, the composite material is extremely useful in energetic material compositions, such as propellants, explosives, pyrotechnics, and other such energetic materials that are aided with the addition of an aluminum component.

Examples of fluoronitro SAM non-linking molecules are set forth in FIG. 3. Fluoro-nitro-carboxylic acids (3), (4), and (5) may be synthesized via the esterification of the cyclic anhydride (2) with nitro- and fluoro-nitro (nitrate ester) compounds 3*a*, 4*a*, and 5*a* possessing a primary alcohol moiety. The energetic carboxylic alcohols (3*a*), (4*a*), and (5*a*) were treated with one equivalent of 1M NaOH, followed by treatment with the cyclic anhydride (2) at 0° C. Neutralization during work up yields the desired products (3), (4), and (5).

The cyclic anhydride (2) may be formed by dehydrating the perfluoro-dicarboxylic acid (1) using an excess of acetic anhydride ($Ac_2O$) under refluxing conditions. Alternatively, phosphorous pentoxide ($P_2O_5$) will be used in place of acetic anhydride to prepare the perfluorocyclic anhydride (2) in THF.

In another optional modification to the embodiment of the present invention, some or all of the molecules constituting the self-assembled monolayer includes a crosslinkable moiety. Incorporation of polymerizable crosslinking functional groups into the mono- and/or multifunctional molecules may serve to increase the interconnections, or networking, of the composite material. For example, a portion of the SAM molecules may include crosslinkable ethylenic unsaturation (i.e., carbon-carbon double bonds), e.g., undecylenic acid ($C_{11}H_{20}O_2$), which may be crosslinked, for example, with any radical initiator, such as AIBN (a nitrogen based initiator) or simple hydrogen peroxide. Following SAM formation on the particle, a terminal unsaturation may be elaborated upon to provide a wide variety of crosslinkable moieties such as alcohol, halide, or aldehyde provided a crosslinking agent is used. Alternatively, a crosslinking agent such as a diisocyanate-containing species (e.g., tetramethylxylyldiisocyanate) may be used with amine terminated SAM material to form pseudo-urethane (or urea) crosslinks. Other crosslinking agents such as diepoxides may also be used with amine terminated SAM species producing 2° amino alcohol crosslinks. Epoxide-capped SAMs could conversely be crosslinked via the addition of a diamine, such as a simple diamine (e.g., ethylenediamine). Other radical, condensation, and nucleophilic crosslinking systems may likewise be used.

Method for Making

The composite material is produced in accordance with an embodiment of this invention by combining the SAM-forming molecules, the inorganic particles, and a suitable solvent. The sequence for combining these ingredients is not particularly limited, although it is preferred to add the SAM-forming molecules to the inorganic particles while the inorganic particles are dispersed in a suitable solvent. In the event that unprotected aluminum particles are selected as the inorganic particles, the SAM-forming molecules are preferably added to and reacted with the bare aluminum mass in an inert atmosphere prior to any oxidation of the surface of the bare aluminum mass, thereby substantially passivating the aluminum particles against oxidation. The combination of ingredients may be performed under any conditions suitable for the formation of bonds between the SAM molecules and inorganic particles. By way of example, the SAM molecules and inorganic particles may be combined together with the solvent at room temperature. During formation of the self-assembled monolayer, the solvent is preferably but optionally stirred or otherwise physically manipulated for an adequate duration, e.g., overnight, to effect uniform dispersion of the particles within the composite material.

Diethyl ether and heptane have been found to be useful solvents. However, it is believed that the solvent may be any appropriate aromatic solvent such as toluene, benzene, and mesitylene; a polar solvent such as propyl ether, isopropylether, dimethoxymethane, tetrahydrofuran, diglyme, triglyme, and tetraglyme; an aliphatic solvent such as hexane, octane, and nonane; or an amine such as triethylamine, tripropylamine, triisopropylamine, and pyridine.

Without wishing to be bound by theory, it is believed that the self-assembled monolayers are formed as a result of spontaneous adsorption and organization of diluted adsorbate molecules, i.e., the linking and non-linking molecules, on the solid surfaces of the inorganic particles. Simultaneously, the linking molecules form a network interconnecting and the inorganic particles to one another and substantially immobilizing the particles in the matrix against migration.

Once the composite is formed, the liquid can be removed to leave behind a structure formed from the composite material. Liquid removal can be effected by a variety of techniques, including filtration and/or evaporation, with or without the assistance of a vacuum.

The process for producing the composite material may also comprise a step of forming the inorganic particles. Preferably the step of forming the unprotected aluminum mass includes processing a composition of $AlH_3.NR_1R_2R_3$, with $R_1$, $R_2$ and $R_3$ independently being hydrogen or an alkyl having from about 1 to about 10 carbon atoms, that are optionally in combination with one or more heterocycles. In one embodiment, the process includes a solution of known concentration of $AlH_3.NR_3$ (R=alkyl) in a suitable solvent, such as ether, e.g., diethyl ether, that is decomposed by the addition of a catalytic amount of $Ti(O^iPr)_4$.

After the decomposition is effected and the bare aluminum mass begins to nucleate, the self-assembled monolayer may be formed on the aluminum for passivation purposes. For example, a solution of perfluoroalkyl carboxylic acid and diacid in ether is added slowly to reduce heat generation, such as dropwise. Without the use of excess complexing amine—as referenced in the Higa patent, the time of Al particle nucleation may be monitored to prevent aluminum film formation on the walls of the reaction vessel. Representative times for nucleation may include, for example without limitation, 5 minutes, 7 minutes, 10 minutes, and other such times effective for highest degree of Al particle nucleation while preventing film formation of the atomic aluminum. This allows larger Al particle sizes without film formation prior to passivation with the SAM molecules. The carboxylic acid moieties react with the inorganic (e.g., bare aluminum) surface, releasing hydrogen and forming a covalent aluminum-oxygen bond. The long chain perfluoroalkyl moieties are thereby linked with the aluminum particle. Attachment of a plurality of attaching molecules to the surface of the aluminum particle coats the entire surface of the aluminum particle with a self-assembled monolayer of perfluoroalkyl carboxylic acid and diacid moieties and prevents the nucleation (Ostwald ripening) of the Al particles.

Composite Articles

The energetic composite material of embodiments of this invention is preferably formable into a composite article by casting, pressing, and/or sintering. Examples of composite articles that may be made of the energetic composite material include ammunition casings and reactive projectiles.

For example, FIGS. 4A and 4B illustrate a projectile generally designated by reference numeral 40. The projectile 40 comprises a nose tip 42, a structural case 44 having reactive filler 46, an aft motor portion 48 and fins 50. In the illustrated embodiment, embodiments of the composite material of the present invention may be used for formation of the structural case 44 and/or the reactive filler 46 loaded in the case 44. Reactive cases 44 may include metal particles such as, for example, aluminum and tungsten. The reactive filler 46 may optionally but preferably include aluminum particles, a SAM network, and a polymeric binder. Examples of polymeric binders are well known and reported in the art.

The composite article may include additional components, including, for example, binders, stabilizers, energetic and non-energetic fillers, and other additives, including those common to composite articles.

Advantageously, composite materials produced according to embodiments of the present invention may be processed using a wide variety of techniques, including sintering, pressing, and/or casting. Further, many additional advantages are derived from the self-assembled monolayer structure formed on the inorganic particles. For example, the formation of a self-assembled monolayer coating on a bare metal particle, such as a bare aluminum mass, prevents or retards the oxidization of the particle in air. Further, the self-assembled monolayer coating may improve the electrostatic discharge (ESD) sensitivity of the material. The interconnecting or networking of the metal particles establishes a composite material with bulk physical and chemical properties that may be controlled by, or at least influenced by, various parameters, including the particle composition, particle size and density, multi-functionality of the self-assembled monolayer, chain length of the multifunctional linking molecules and non-linking molecules, crosslinking groups, reactive functional groups, as well as other factors.

EXAMPLES

The following examples serve to explain and elucidate the principles and practice of the present invention further. These examples are merely illustrative, and not exhaustive as to the scope of the present invention.

Example 1

Oxygen-passivated aluminum (Op—Al; H-2, Valimet; 2 μm avg. particle size) (25 g, 0.93 mol) and diethyl ether (75 mL) were stirred in a 500 mL round bottom flask at room temperature. Perfluorotetradecanoic acid, $C_{14}F_{27}O_2H$, (0.943 g, 0.00132 mol) was dissolved in ether (10 mL) and added to the Op—Al. Polyethylene glycol 600 diacid (5 mol % of the coating species, 0.040 g, 0.066 mmol) was dissolved in 1 mL monoglyme and added to the reaction flask. The reaction was capped and stirred overnight. The ether was then removed and the material was allowed to dry at room temperature in the hood, resulting in a fine gray powder. Yield: 25.943 g.

Example 2

Op—Al (H-5, Valimet; 5 μm avg. particle size) (30 g, 1.11 mol) and ether (75 mL) were stirred in a 500 mL round bottom flask. Perfluorotetradecanoic acid, $C_{14}F_{27}O_2H$, (0.90 g, 0.00126 mol) was dissolved in diethyl ether (10 mL) and added to the Op—Al. Polyethylene glycol diacid 600 (10 mol % of the estimated number of carboxylic acid moieties required for complete coverage of the Op—Al particles, 0.040 g, 0.000063 mol) was dissolved in 1 mL monoglyme and added to the reaction flask. The reaction was capped and stirred overnight. The ether was then removed and the aluminum was allowed to dry in the hood resulting in a fine gray powder. Yield: 30.094 g

Example 3

Nano-Al Coated and Networked with Perfluorosebacic Acid $HO_2C_{10}F_{16}O_2H$;

Examples 3 and 4 were performed in the absence of oxygen, water, and other reactive species in an argon-filled glove box. A solution of diethyl ether (30 mL) and alane-N-methylpyrrolidine complex, $H_3Al.N(Me)Pyr$, (0.75 g, 0.0065 mol) was stirred at room temperature. To this solution a solution of 10 μL of titanium isopropoxide $Ti(O^iPr)_4$ in 1 mL toluene was rapidly added via syringe. The reaction was stirred for 7 minutes, during which the solution became dark brown in color. After 7 minutes, a solution of 0.965 g (0.00197 mol), $HO_2C_{10}F_{16}O_2H$, in 20 mL diethyl ether was added dropwise to the reaction flask at a drop rate of 3-4 drops per second. The reaction was stirred overnight, after which stirring was stopped and the reaction contents were allowed to settle. The clear, colorless ether layer was removed by pipette from the dark gray powder. The powder was washed with 10-mL portions of diethyl ether and the ether was removed after the solid settled out. The powder was dried by allowing the residual ether to evaporate in the glove box. The resulting gray solid was found to be stable in air.

Example 4

Nano-Al Coated with Perfluorononanoic Acid $C_9F_{19}O_2H$, and Networked with Polyethylene Glycol 600 Diacid A solution of diethyl ether (20 mL) and $H_3Al.N(Me)Pyr$ (0.75 g, 0.0065 mol) was stirred at room temperature. To this solution $Ti(O^iPr)_4$ (10 μL in 1 mL toluene) was rapidly added via syringe. The reaction was stirred for 7 minutes, during which the reaction became dark brown in color. After 7 minutes, a solution of $C_9F_{19}O_2H$ (0.604 g; 0.0013 mol) in 10 mL diethyl ether and 0.078 g (0.00014 mol) polyethylene glycol 600 diacid in 5 ml monoglyme was added dropwise to the reaction flask at a drop rate of 3-4 drops per second. The reaction was stirred overnight, after which stirring was stopped and the reaction contents allowed to settle. The clear, brown ether layer was removed by pipette from the dark gray powder. The material was washed with 20 mL of diethyl ether and the ether was removed after the solid settled out. The powder was dried by allowing the residual ether to evaporate in the glove box. The resulting gray powder was stable in air.

The foregoing detailed description of the preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims.

What is claimed is:

1. An energetic composite material, comprising:

inorganic particles being selected from the group consisting of metals, metalloids, metal oxides, and metalloid oxides; wherein said particles comprise more than one atom per particle and self-assembled monolayers being formed on the inorganic particles, the self-assembled monolayers comprising multifunctional linking molecules and optionally non-linking molecules, the multifunctional linking molecules each comprising a respective linking backbone and respective first and second terminal, linking functional groups, wherein the first and second terminal, linking functional groups are chemically bonded to respective surfaces of a corresponding pair of the inorganic particles so that the multifunctional linking molecules interconnect at least three of the inorganic particles to one another to form a network of the inorganic particles interconnected by the multifunctional linking molecules, which are intermediate the organic particles, wherein the optional non-linking molecules each comprise a respective non-linking backbone and a respective non-linking functional group, the respective non-linking functional group is chemically bonded to a corresponding one of the inorganic particles, and wherein a member selected from at least one of the multifunctional linking molecules and the optional non-linking molecules comprises a fluorine atom appended to at least one of the linking backbone and the non-linking backbone, respectively, to fluorinate the self-assembled monolayer.

2. An energetic composite material according to claim 1, wherein the inorganic particles have an average diameter in a range of about 5 nm to about 3 microns.

3. An energetic composite material according to claim 1, wherein the inorganic particles comprise a metal selected from the group consisting of magnesium, aluminum, boron, titanium, tungsten, and hafnium.

4. An energetic composite material according to claim 1, wherein the inorganic particles comprise a metal oxide selected from the group consisting of aluminum oxide, titanium oxide, molybdenum oxide, vanadium oxide, and iron oxide.

5. An energetic composite material according to claim 1, wherein the inorganic particles comprise oxygen passivated aluminum.

6. An energetic composite material according to claim 1, wherein the linking backbones each comprise a carbon atom.

7. An energetic composite material according to claim 1, wherein the linking backbones comprise a member selected from the group consisting of polyethers, hydrocarbons, and fluorocarbons.

8. An energetic composite material according to claim 1, wherein about 5 weight percent to about 100 weight percent of the self-assembled monolayers consists of the multifunctional linking molecules.

9. An energetic composite material according to claim 1, wherein the first and second terminal, linking functional groups are the same or different, and are selected from the group consisting of carboxylic acid, alcohol, thiol, aldehyde, and amide moieties.

10. An energetic composite material according to claim 1, wherein the first and second terminal, linking functional groups each consists of a respective carboxylic acid terminal moiety.

11. An energetic composite material according to claim 1, wherein the linking backbone has a plurality of fluorine atoms appended thereto.

12. An energetic composite material according to claim 1, wherein the linking backbone is perfluorinated.

13. An energetic composite material according to claim 1, wherein the multifunctional linking molecules comprise $HOOC(CF_2)_nCOOH$, wherein n is in a range of 3 to about 20.

14. An energetic composite material according to claim 1, wherein the non-linking molecules constitute from about 1 weight percent to about 95 weight percent of the self-assembled monolayers.

15. An energetic composite material according to claim 14, wherein the non-linking backbone comprises a carbon atom.

16. An energetic composite material according to claim 15, wherein the non-linking backbone has a plurality of fluorine atoms appended thereto.

17. An energetic composite material according to claim 15, wherein the non-linking backbone is perfluorinated.

18. An energetic composite material according to claim 14, wherein the non-linking molecules comprise $CF_3(CF_2)_n$ COOH, wherein n is in a range of 3 to about 20.

19. An energetic composite material according to claim 1, wherein a member selected from the group consisting of the multifunctional linking molecules and the non-linking molecules further comprises an energetic group.

20. An energetic composite material according to claim 19, wherein the energetic group comprises a member selected from the group consisting of a nitro, nitramine, nitrate ester, azide, and difluoro amino moiety.

21. An energetic composite material according to claim 1, wherein a member selected from the group consisting of the multifunctional linking molecules and the non-linking molecules comprises an ethylenically unsaturated crosslinkable group.

22. An energetic composite material according to claim 1, wherein the energetic composite material is castable, pressable, and/or sinterable.

23. An energetic composite material comprising:

a plurality of aluminum particles substantially free of oxygen; wherein said particles comprise more than one atom per particle and self-assembled monolayers formed on the aluminum particles to substantially passivate the aluminum particles against oxidation, the self-assembled monolayers comprising multifunctional linking molecules, the multifunctional linking molecules each comprising a respective backbone and respective first and second functional groups chemically bonded to a corresponding pair of the aluminum particles to interconnect the aluminum particles, the multi-functional linking molecules forming a network of the aluminum particles interconnected by the multifunctional linking molecules.

24. An energetic composite material according to claim 23, wherein the aluminum particles have an average diameter in a range of about 5 nm to about 3 microns.

25. An energetic composite material according to claim 23, wherein the linking backbone comprises a carbon atom.

26. An energetic composite material according to claim 23, wherein the linking backbone comprises a member selected from the group consisting of polyethers, hydrocarbons, and fluorocarbons.

27. An energetic composite material according to claim 23, wherein about 5 weight percent to about 100 weight percent of the self-assembled monolayers consists of the multifunctional linking molecules.

28. An energetic composite material according to claim 23, wherein at least a portion of the multifunctional linking molecules are difunctional.

29. An energetic composite material according to claim 23, wherein the first and second functional groups are the same or different, and are selected from the group consisting of carboxylic acid, alcohol, thiol, aldehyde, and amide moieties.

30. An energetic composite material according to claim 23, wherein the first and second function groups each consists of a respective carboxylic acid terminal moiety.

31. An energetic composite material according to claim 23, wherein the self-assembled monolayers further comprise non-linking molecules constituting from about 1 weight percent to about 95 weight percent of the self-assembled monolayers.

32. An energetic composite material according to claim 31, wherein a member selected from the group consisting of the multifunctional linking molecules and the non-linking molecules further comprises an energetic group.

33. An energetic composite material according to claim 32, wherein the energetic group comprises a member selected from the group consisting of a nitro, nitramine, nitrate ester, azide, and difluoro amino moiety.

34. An energetic composite material according to claim 31, wherein a member selected from the group consisting of the multifunctional linking molecules and the non-linking molecules comprises an ethylenically unsaturated crosslinkable group.

35. An energetic composite material according to claim 23, wherein the energetic composite material is castable, pressable, and sinterable.

36. An energetic composite material comprising:

a plurality of aluminum particles substantially free of oxygen; wherein said particles comprise more than one atom per particle and self-assembled monolayers formed on the aluminum particles to substantially passivate the aluminum particles against oxidation, the self-assembled monolayers comprising multifunctional linking molecules and optionally non-linking molecules, the multifunctional linking molecules each comprising a respective linking backbone and respective first and second linking functional groups, the first and second linking functional groups chemically bonding to a corresponding pair of the aluminum particles so that the multifunctional linking molecules interconnect the aluminum particles to one another to form a network of aluminum particles interconnected by the multifunctional linking molecules, the optional non-linking molecules each comprising a respective non-linking backbone and a non-linking functional group, the non-linking functional group chemically bonding to a corresponding one of the aluminum particles, wherein a member selected from the multifunctional linking molecules and the optional non-linking molecules comprises a fluorine atom appended to the first and second carbon atoms, respectively, to fluorinate the self-assembled monolayer.

37. An energetic composite material according to claim 36, wherein the aluminum particles have an average diameter in a range of about 5 nm to about 3 microns.

38. An energetic composite material according to claim 36, wherein the linking backbone comprises a carbon atom.

39. An energetic composite material according to claim 36, wherein the linking backbone comprises a member selected from the group consisting of polyethers, hydrocarbons, and fluorocarbons.

40. An energetic composite material according to claim 36, wherein about 5 weight percent to about 100 weight percent of the self-assembled monolayers consists of the multifunctional linking molecules.

41. An energetic composite material according to claim 36, wherein at least a portion of the multifunctional linking molecules are difunctional.

42. An energetic composite material according to claim 36, wherein the first and second linking functional groups are the same or different, and are selected from the group consisting of carboxylic acid, alcohol, thiol aldehyde, and amide moieties.

43. An energetic composite material according to claim 36, wherein the first and second linking functional groups each consists of a respective carboxylic acid terminal moiety.

44. An energetic composite material according to claim 36, wherein the linking backbone has a plurality of fluorine atoms appended thereto.

45. An energetic composite material according to claim 36, wherein the linking backbone is perfluorinated.

46. An energetic composite material according to claim 36, wherein the multifunctional linking molecules comprise $HOOC(CF_2)_nCOOH$, wherein n is in a range of 3 to about 20.

47. An energetic composite material according to claim 36, wherein the non-linking molecules constitute from about 1 weight percent to about 95 weight percent of the self-assembled monolayers.

48. An energetic composite material according to claim 47, wherein the non-linking backbone comprises a carbon atom.

49. An energetic composite material according to claim 47, wherein the non-linking backbone has a plurality of fluorine atoms appended thereto.

50. An energetic composite material according to claim 47, wherein the non-linking backbone is perfluorinated.

51. An energetic composite material according to claim 36, wherein a member selected from the group consisting of the multifunctional linking molecules and the non-linking molecules further comprises an energetic group.

52. An energetic composite material according to claim 51, wherein the energetic group comprises a member selected from the group consisting of a nitro, nitramine, nitrate ester, azide, and difluoro amino moiety.

53. An energetic composite material according to claim 36, wherein the energetic composite material is castable, pressable, and/or sinterable.

54. A method for making the energetic composite material according to claim 1, comprising:

dispersing inorganic particles into a solvent, the inorganic particles comprising a member selected from the group consisting of metals, metalloids, metal oxides, and metalloid oxides;

dissolving multifunctional linking molecules and optionally non-linking molecules in the solvent, the multifunctional linking molecules each comprising a respective linking backbone and respective first and second linking functional groups, the optional non-linking molecules each comprising a respective non-linking backbone and a respective non-linking functional group; and self-assembling a monolayer comprising the linking molecules and optionally the non-linking molecules onto the inorganic particles, said self-assembling comprising chemically bonding the first and second linking functional groups to a corresponding pair of the inorganic particles so that the multifunctional linking molecules interconnect the inorganic particles to one another to form a network of inorganic particles interconnected by the multifunctional linking molecules, and optionally chemically bonding the non-linking functional group to a corresponding one of the inorganic particles, wherein a member selected from the multifunctional linking molecules and the optional non-linking molecules comprises a fluorine atom appended to the linking backbone and the non-linking backbone, respectively, to fluorinate the self-assembled monolayer.

55. A method for making an energetic composite material according to claim 23, comprising:

dispersing a plurality of bare aluminum particles substantially free of oxygen in a solvent;

dissolving multifunctional linking molecules and optionally non-linking molecules in the solvent, the multifunctional linking molecules each comprising a respective linking backbone and respective first and second linking functional groups, the optional non-linking molecules each comprising a respective non-linking backbone and a respective non-linking functional group; and self-assembling a monolayer comprising the linking molecules and optionally the non-linking molecules onto the bare aluminum particles to substantially passivate the bare aluminum particles against oxidation and thereby form passivated aluminum particles that are substantially free of oxygen, said self-assembling comprising chemically bonding the first and second linking functional groups to a corresponding pair of the bare aluminum particles so that the multi-functional linking molecules interconnect the passivated aluminum particles to one another to form a network of passivated aluminum particles interconnected by the multifunctional linking molecules, and optionally chemically bonding: the non-linking functional group to a corresponding one of the inorganic particles.

56. A method for making the energetic composite material according to claim 36, comprising:

dispersing a plurality of bare aluminum particles substantially free of oxygen in a solvent;

dissolving multifunctional linking molecules and optionally non-linking molecules in the solvent, the multifunctional linking molecules each comprising a respective linking backbone and respective first and second linking functional groups, the optional non-linking molecules each comprising a respective non-linking backbone and a respective non-linking functional group; and self-assembling a monolayer comprising the linking molecules and optionally the non-linking molecules onto the bare aluminum particles to substantially passivate the bare aluminum particles against oxidation and thereby form passivated aluminum particles that are substantially free of oxygen, said self-assembling comprising chemically bonding the first and second linking functional groups to a corresponding pair of the bare aluminum particles so that the multi-functional linking molecules interconnect the passivated aluminum particles to one another to form a network of passivated aluminum particles interconnected by the multifunctional linking molecules, and optionally chemically bonding the non-linking functional group to a corresponding one of the bare aluminum particles, wherein a member selected from the multifunctional linking molecules and the optional non-linking molecules comprises a fluorine atom appended to the linking backbone and the non-linking backbone, respectively, to fluorinate the self-assembled monolayer.

57. An article of manufacture comprising an energetic composite material according to claim 1.

58. An article of manufacture according to claim 57, wherein the article is an ammunition casing.

59. An article of manufacture comprising an energetic composite material according to claim 23.

60. An article of manufacture according to claim 59, wherein the article is an ammunition casing.

61. An article of manufacture comprising an energetic composite material according to claim 36.

62. An article of manufacture according to claim 61, wherein the article is an ammunition casing.

* * * * *